US007261204B2

(12) United States Patent
Zaidi et al.

(10) Patent No.: US 7,261,204 B2
(45) Date of Patent: Aug. 28, 2007

(54) ELECTRIC METER TOTE

(75) Inventors: Hasan M. Zaidi, West Bloomfield, MI (US); Joseph S. Wycech, Grosse Pointe Shores, MI (US)

(73) Assignee: The Detroit Edison Company, Detroit, MI (US)

( * ) Notice: Subject to any disclaimer, the term of this patent is extended or adjusted under 35 U.S.C. 154(b) by 365 days.

(21) Appl. No.: 10/915,924

(22) Filed: Aug. 11, 2004

(65) Prior Publication Data

US 2006/0032783 A1 Feb. 16, 2006

(51) Int. Cl.
*B65D 85/38* (2006.01)

(52) U.S. Cl. ..... 206/305; 206/485; 206/486; 206/526; 206/725

(58) Field of Classification Search ..... 206/320, 206/485, 485.1, 486, 526, 509, 564, 523, 206/591, 592, 594, 722, 723, 725, 305
See application file for complete search history.

(56) References Cited

U.S. PATENT DOCUMENTS 3,366,231 A * 1/1968 Trakas ..... 206/320
5,011,020 A * 4/1991 Stevens et al. ..... 206/570
5,040,678 A * 8/1991 Lenmark et al. ..... 206/523
5,271,499 A * 12/1993 Van Horssen ..... 206/523
5,320,223 A * 6/1994 Allen ..... 206/523
5,794,773 A * 8/1998 Moyer ..... 206/523
6,152,303 A * 11/2000 Ducote et al. ..... 206/523
6,375,408 B1 * 4/2002 Carter ..... 206/725

* cited by examiner

*Primary Examiner*—Luan K. Bui
(74) *Attorney, Agent, or Firm*—Reising, Ethington, Barnes, Kisselle, P.C.

(57) ABSTRACT

A tote for carrying electric meters includes a lid section having a hinged connection to a base section for pivotal movement between open and closed positions, and a latching system releasably securing the lid and base sections together. Each of the sections is provided with a plurality of cavities. When the lid section is closed, the cavities in the lid section confront the cavities in the base section to provide a plurality of pockets. Each pocket is adapted to receive and locate one of the meters. The sections may be separable from one another. The hinged connection permits the lid section to be raised to clear the meters prior to being pivoted open. The cavities in the two sections may be formed by panel inserts which are removable for replacement by other panel inserts adapted to accommodate larger or smaller meters.

5 Claims, 7 Drawing Sheets

ELECTRIC METER TOTE

This invention relates generally to totes and more particularly to a tote for carrying articles such as electric meters.

BACKGROUND OF THE INVENTION

Electric meters are employed to take readings of electrical usage at residential and commercial sites. Currently, electric meters are received from the manufacturer in corrugated cardboard boxes. The box are considered throw-away items and are discarded after the meters are removed and put into use by field personnel. What is needed is a tote for electric meters which may be used over and over, and not discarded after each use.

SUMMARY OF THE INVENTION

In accordance with one embodiment of the present invention, a tote is provided for carrying articles such as electric meters, having a lid section and a base section, each section being formed with a plurality of cavities. When the tote is closed, the cavities in the lid section confront the cavities in the base section to provide a plurality of pockets. Each pocket is adapted to receive one of the meters.

Further, in accordance with the invention, the sections of the tote are hinged together for swinging movement between open and closed positions. The hinge is constructed to enable the lid section to be lifted relative to the base section before the lid section is pivoted to open position, so that the lid section can pivot clear of the meters.

The tote of this invention also has novel latches for releasably retaining the lid section closed relative to the base section.

The tote of this invention is capable of being used many times without requiring replacement. The tote may be returned to the manufacturer for further shipments. It may be used for the delivery of used meters to a repair shop. Heretofore, used meters returned to the repair shop were often damaged in the return shipment.

In another embodiment, the base section and the lid section each have removable panel inserts. The panel inserts in each section cooperate to form a plurality of cavities. When the tote is closed, the cavities in the lid section confront the cavities in the base section to provide pockets for the meters. The panel inserts may be removed and replaced by others which have larger or smaller cavities to accommodate larger or smaller meters.

One object of this invention is to provide a tote having the foregoing features and capabilities.

Another object is to provide a tote of simple and yet durable construction.

Other objects, features and advantages of the invention will become more apparent as the following description proceeds, especially when considered with the accompanying drawings.

DETAILED DESCRIPTION OF THE PREFERRED EMBODIMENTS

Figure 1:
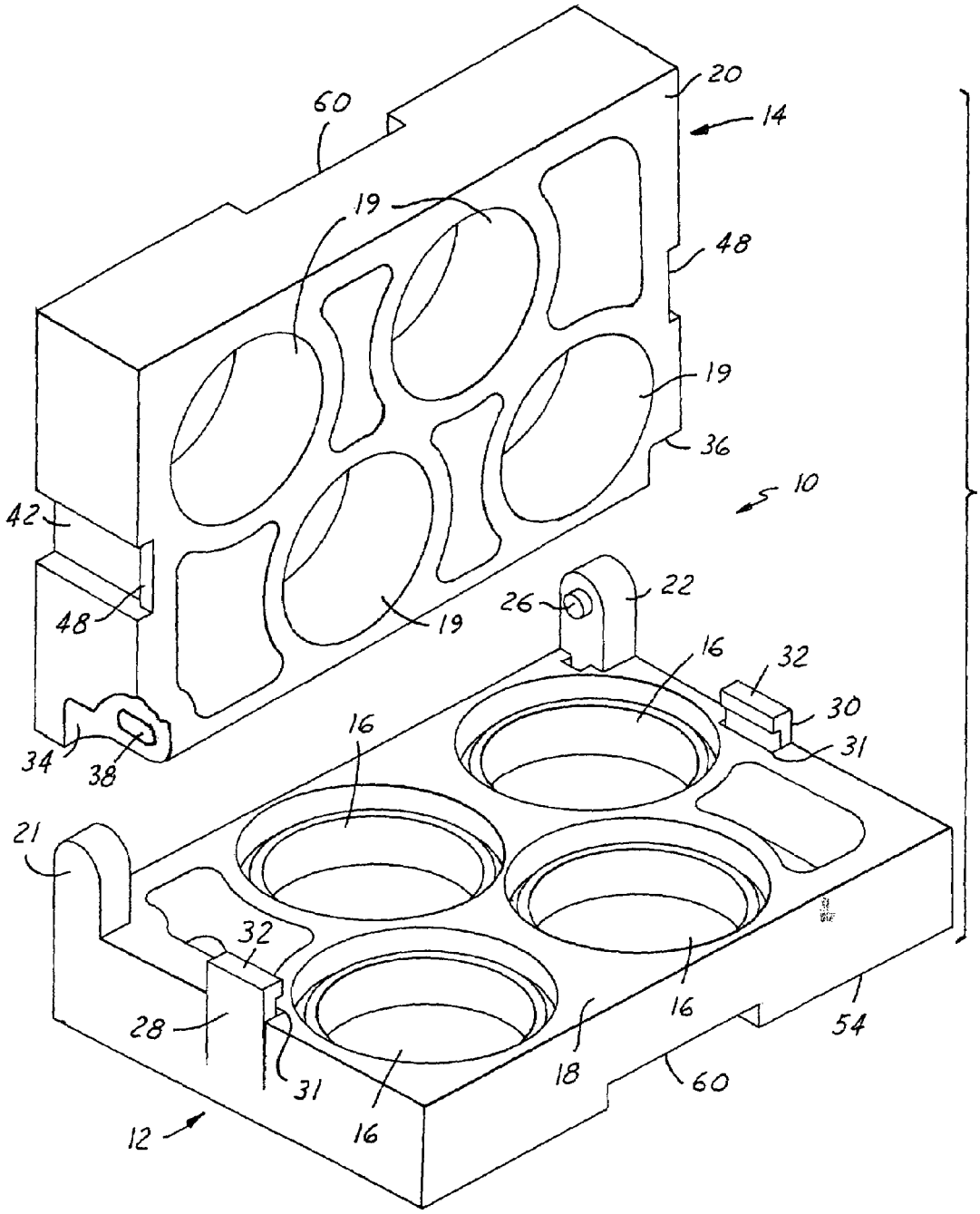
FIG. 1 is a perspective view of a tote constructed in accordance with this invention, showing the lid section of the tote separated from the base section.

Referring now more particularly to the drawings, and especially FIGS. 1-6, there is shown a tote 10 constructed in accordance with this invention, having a base section 12 and a lid section 14. The sections 12 and 14 preferably are each of one-piece, integral construction formed by molding and made of a suitable material such as polyprophylene.

A plurality of spaced apart cavities 16 are formed in a flat inner surface 18 of the base section 12. A plurality of spaced apart cavities 19 are formed in a flat inner surface 20 of the lid section 14. When the lid section is closed on the base section as in FIG. 4, the cavities 19 of the lid section are aligned with and confront respective cavities 16 of the base section to provide a plurality of pockets for receiving electric meters M.

The base section 12 is preferably of generally rectangular shape. Projecting upwardly from the inner surface 18 at the two rear corners of the base section 12 are laterally spaced posts 21 and 22. The post 21 has a cylindrical hinge pin 24 and the post 22 has a cylindrical hinge pin 26. The hinge pins 24 and 26 are in horizontal alignment and project laterally inwardly from the posts toward one another. The posts are capable of flexing laterally outwardly. They are shown in FIG. 5 in solid lines in their natural, unflexed, free state condition and in broken lines flexed laterally outwardly.

Figure 6:
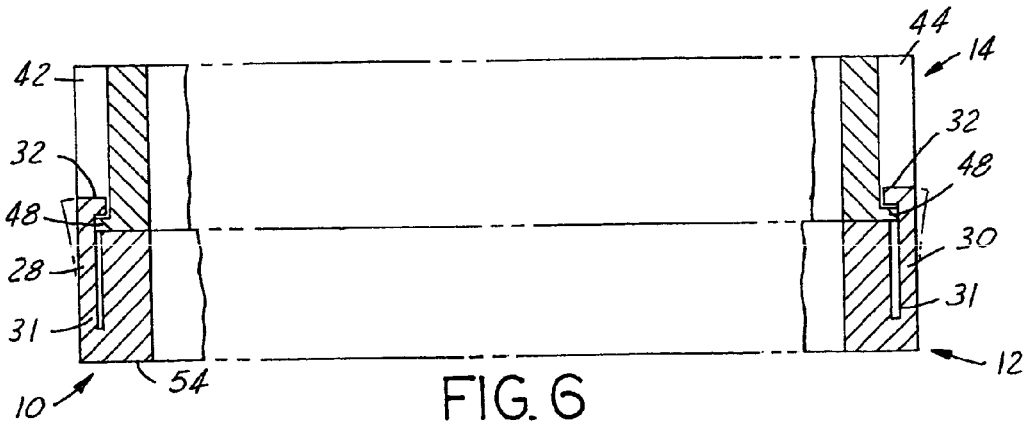
FIG. 6 is a perspective view taken on the line 6-6 in FIG. 4.
Figure 7:
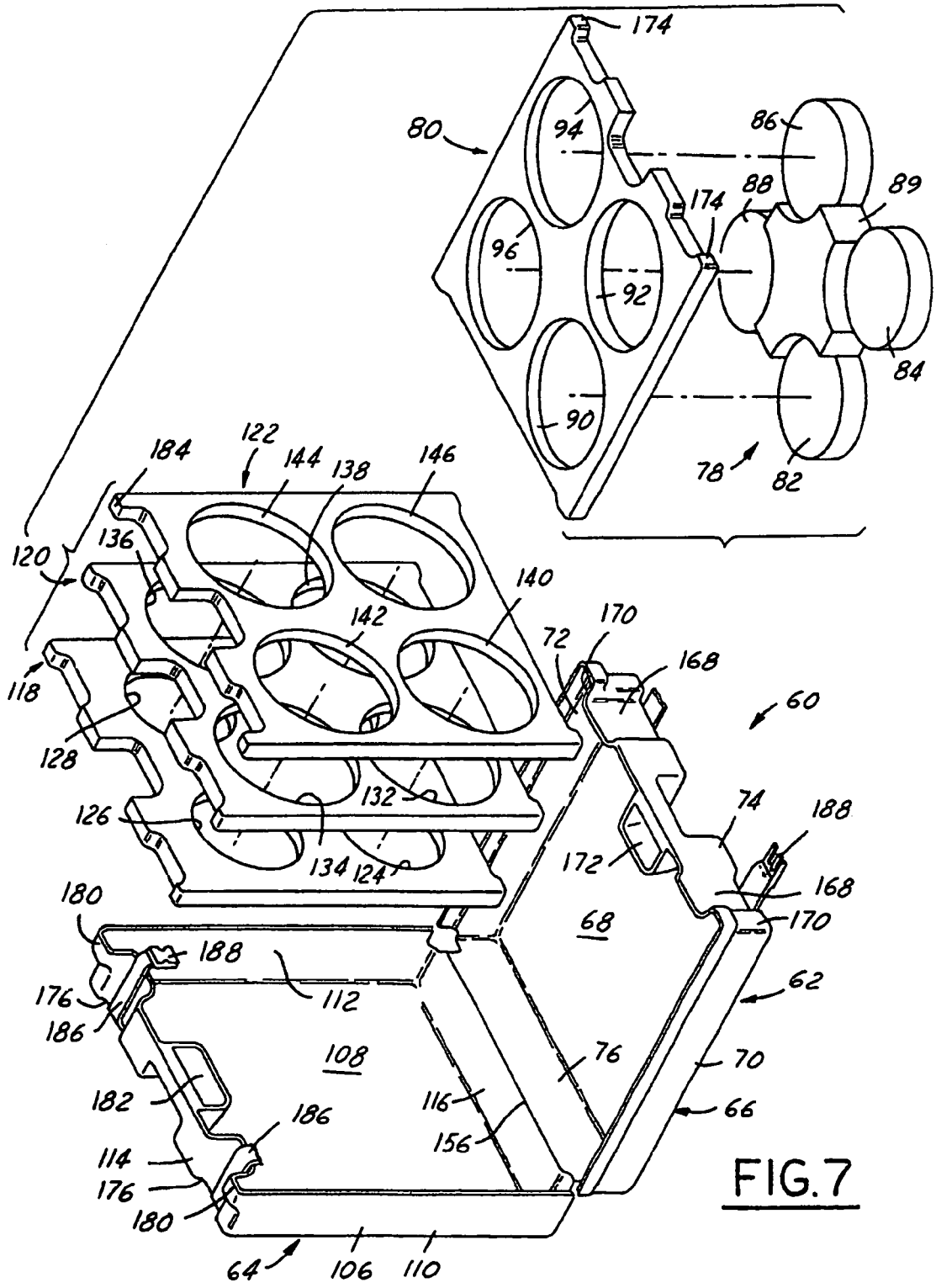
FIG. 7 is an exploded, perspective view of a tote of modified construction, also made in accordance with the present invention.
Figure 8:
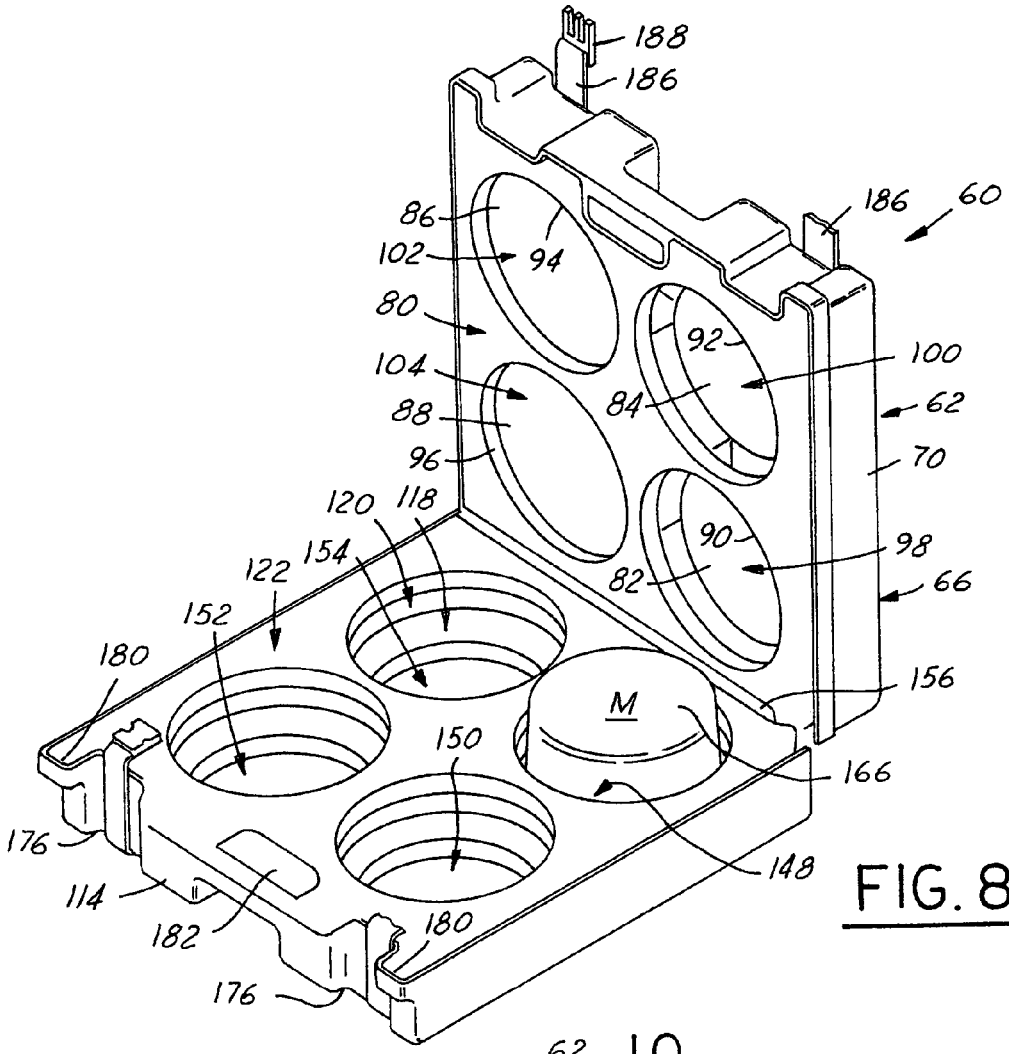
FIG. 8 is a perspective view of the tote shown in FIG. 7, shown in an open position.
Figure 9:
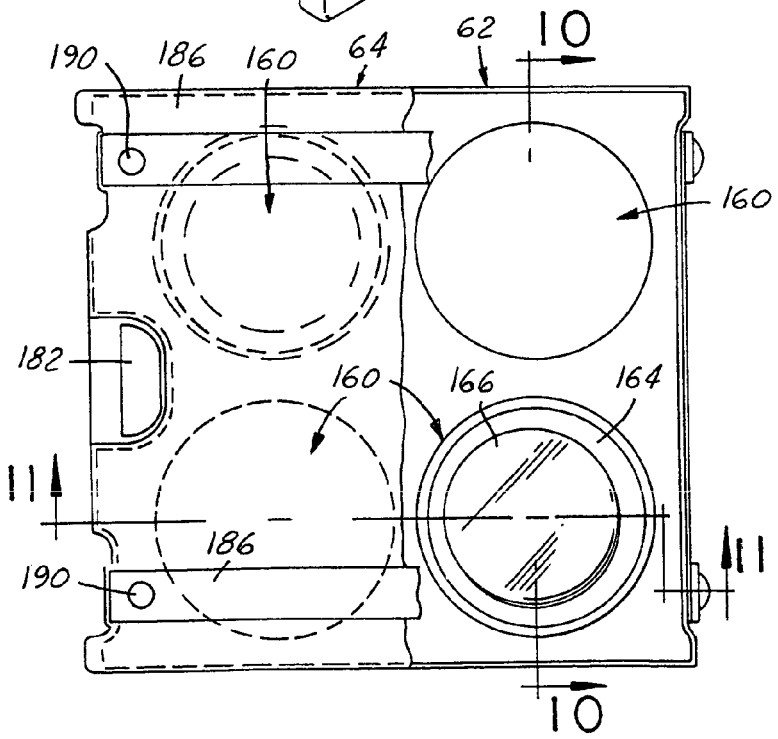
FIG. 9 is an elevational view of the tote of FIGS. 7 and 8 with parts broken away.
Figure 10:
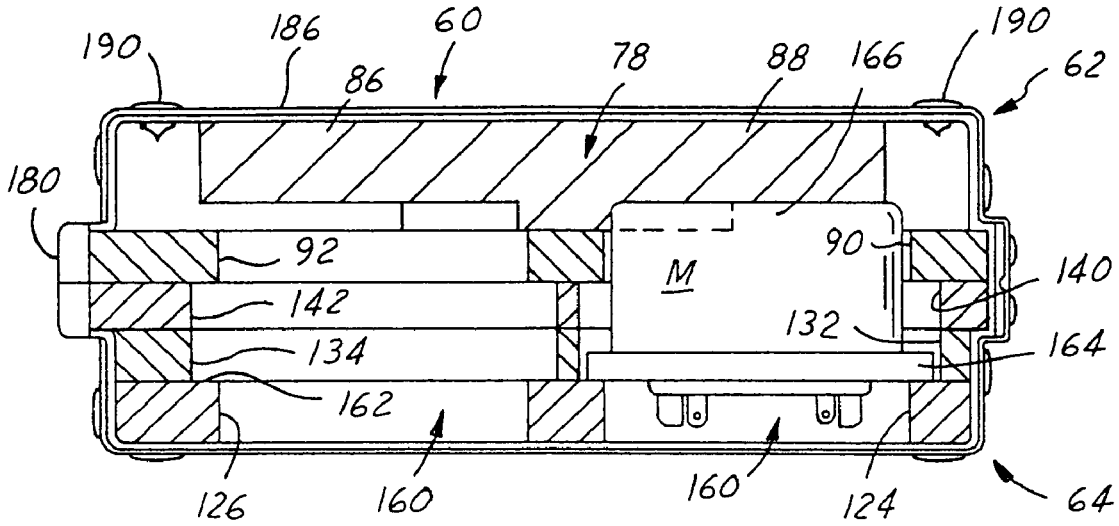
FIG. 10 is a sectional view taken on the line 10-10 in FIG. 9.
Figure 11:
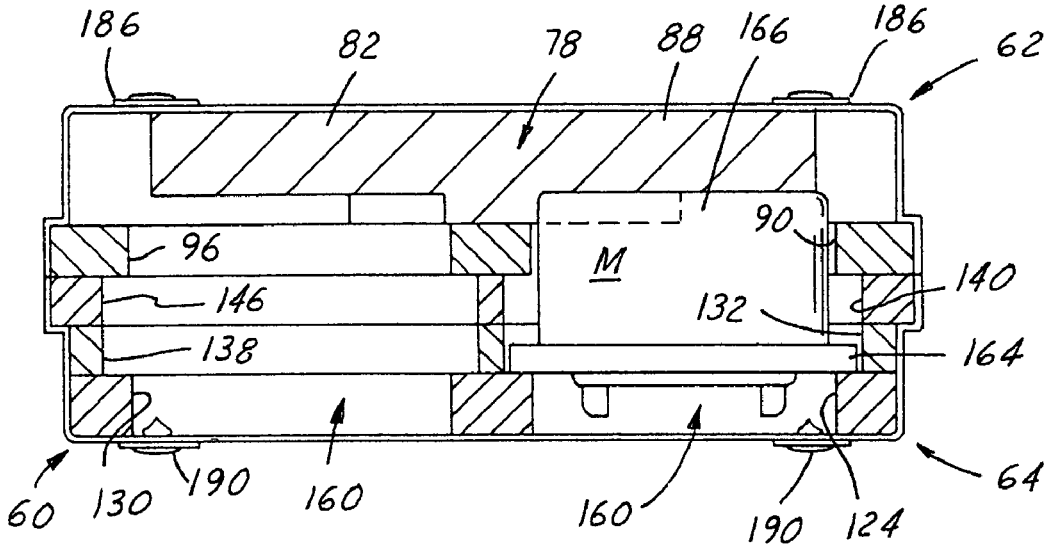
FIG. 11 is a sectional view taken on the line 11-11 in FIG. 9.
Figure 12:
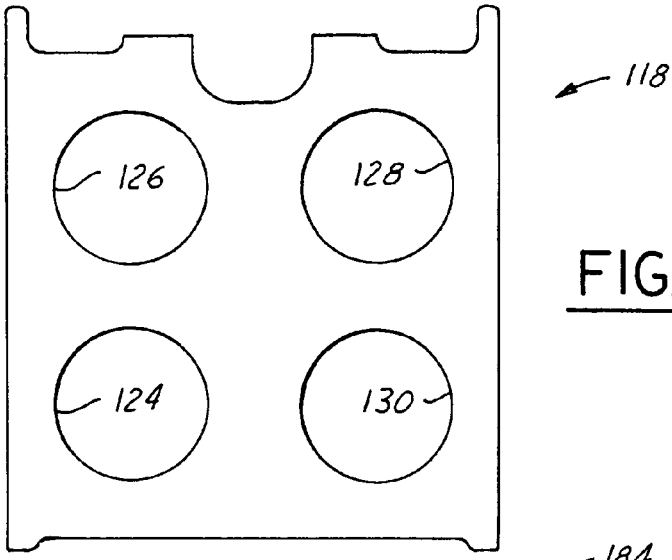
FIG. 12 is an elevational view of one of the panel inserts.
Figure 13:
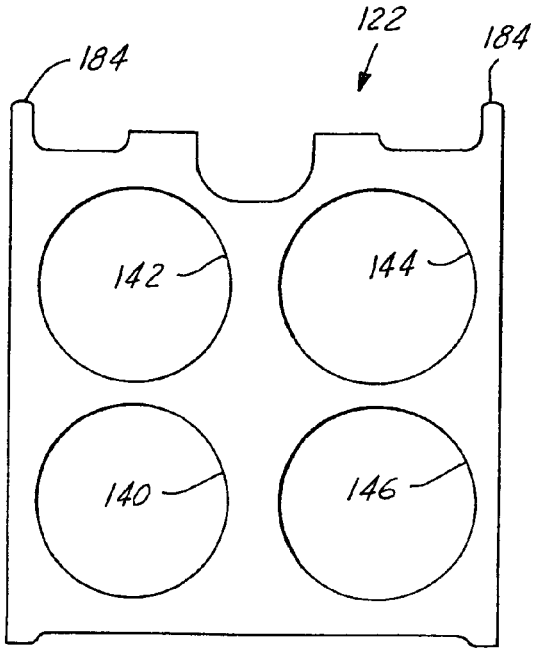
FIG. 13 is an elevational view of another of the panel inserts.
Figure 14:
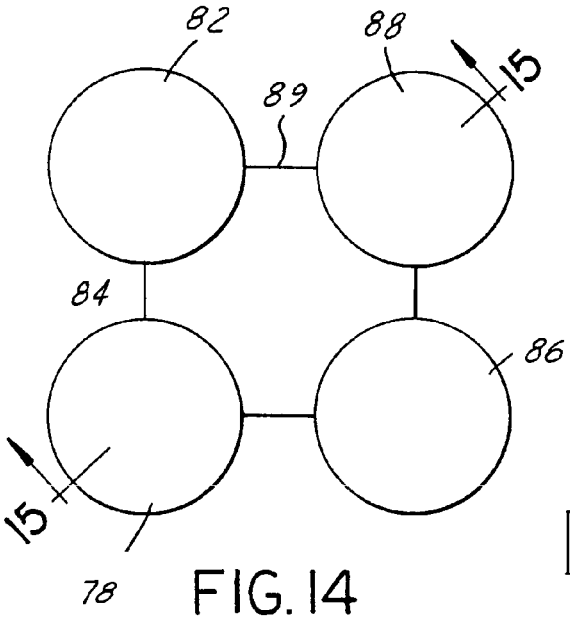
FIG. 14 is an elevational view of still another of the panel inserts.
Figure 15:
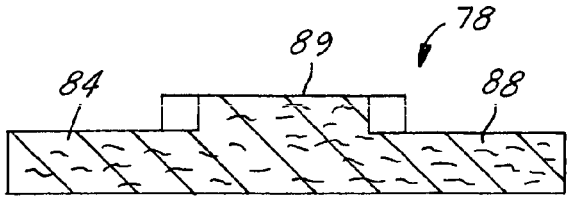
FIG. 15 is a sectional view taken on the line 15-15 in FIG. 14.

A latching system includes a latch 28 which projects upwardly from the inner surface 18 at one side of the base section 12. A latch 30 projects upwardly from the inner surface 18 at the opposite side of the base section 12. The latches 28 and 30 are approximately midway between the front and rear of the base section 12. The sides of the base section 12 have recesses 31 to receive the latches 28 and 30, but the bottoms of the latches are integrally connected to the sides of the base section so that the latches are capable of flexing laterally outwardly as clearly shown in FIG. 6. The latches are shown in FIG. 6 in solid lines in their natural, unflexed, free-state condition, and in broken lines in a laterally outwardly flexed condition. The latches have laterally inwardly projecting prongs 32 at the upper ends.

Figure 4:
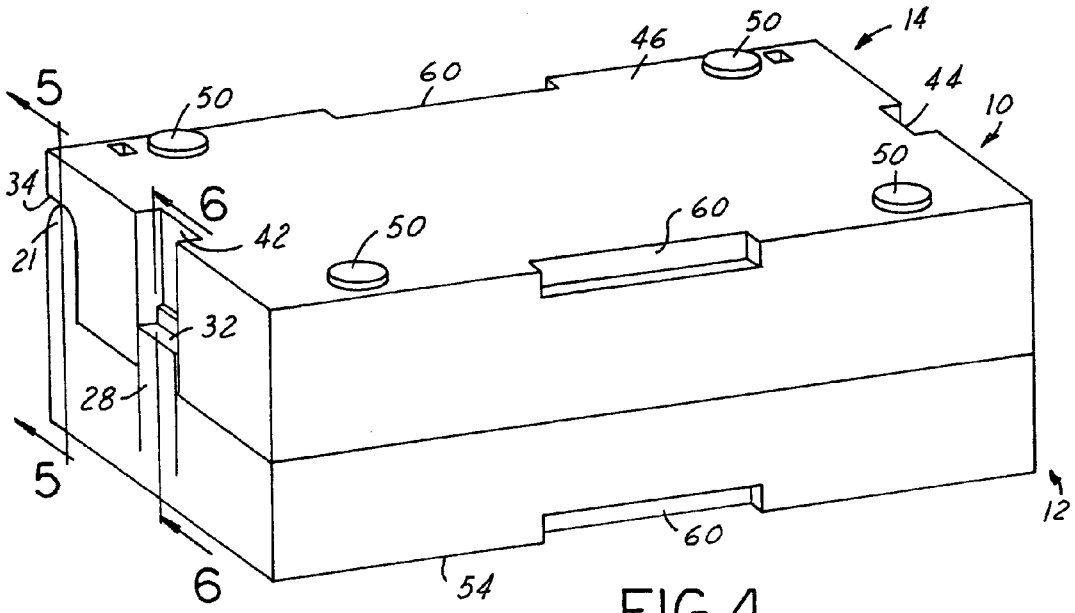
FIG. 4 is a perspective view of the tote showing the lid section closed relative to the base section.

The lid section 14 is preferably of the same generally rectangular configuration as the base section. The lid section 14 has laterally spaced recesses 34 and 36. The recesses 34 and 36 are located at the two rear corners thereof. The recesses 34 and 36 are open at the rear and at the sides of the lid section and are shaped to clear the posts 21 and 22 of the base section 12 when the lid section is closed relative to the base section as shown in FIG. 4.

Figure 5:
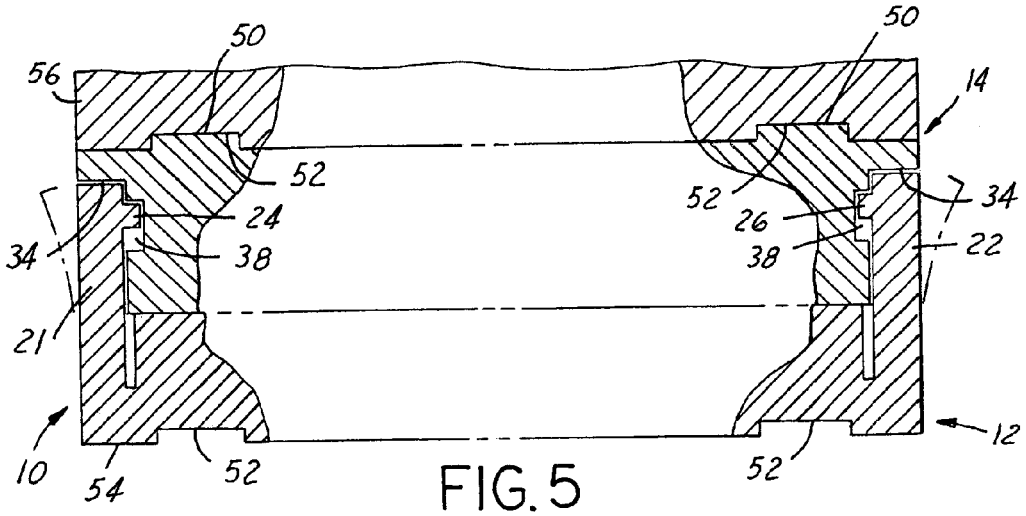
FIG. 5 is a sectional view taken on the line 5-5 in FIG. 4.

Each of the recesses 34, 36 in the lid section has a vertically elongated slot 38 adapted to receive one of the hinge pins 24, 26 when the lid section is closed on the base section and the posts 21 and 22 are in their normal unflexed positions of FIGS. 1-4 and in the solid line position of FIG. 5. The posts are sufficiently flexible that they may be flexed outwardly to the broken line position of FIG. 5 when it is desired to disengage the hinge pins 24, 26 from the slots 38 and separate the lid section from the base section. The vertical elongation of the slots 38 permits the lid section to be raised to the FIG. 3 position relative to the base section prior to pivoting the lid section to the open position shown in FIG. 2.

The lid section has vertical grooves 42 and 44 in the sides which are open from the top surface 46 to the inner surface 20 of the lid section. The grooves 42, 44 are approximately midway between the front and rear of the lid section and are adapted to slidably receive the upper end portions of the latches 28 and 30. The inner wall of each groove has a laterally outwardly extending ledge 48 at the base. The prong 32 on each latch is adapted to engage over one of the ledges 48 when in its unflexed condition and the lid section is closed relative to the base section. This position of the latches 28 and 30 is shown in solid lines in FIG. 6. The latches can be flexed laterally outwardly as shown in broken lines in FIG. 6 to positions such that the prongs 32 clear the ledges 48 and unlatch the lid section so that the lid section can be pivoted to open position.

The top surface 46 of the lid section 14 has a plurality of locator pads 50 adapted to fit into locator sockets 52 in the bottom surface 54 of the base section of a second tote 56 of the same construction when the two totes are closed and are stacked as shown in FIG. 5.

Figure 2:
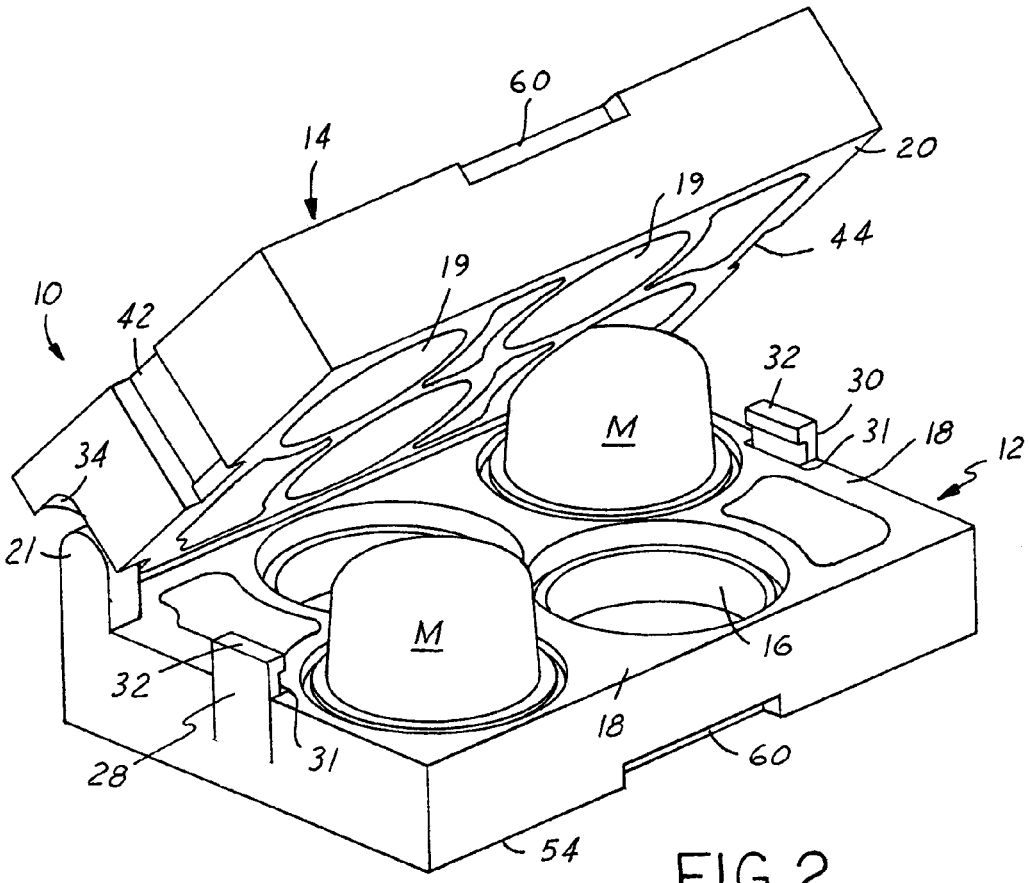
FIG. 2 is a perspective view showing the lid section pivoted to open position relative to the base section.
Figure 3:
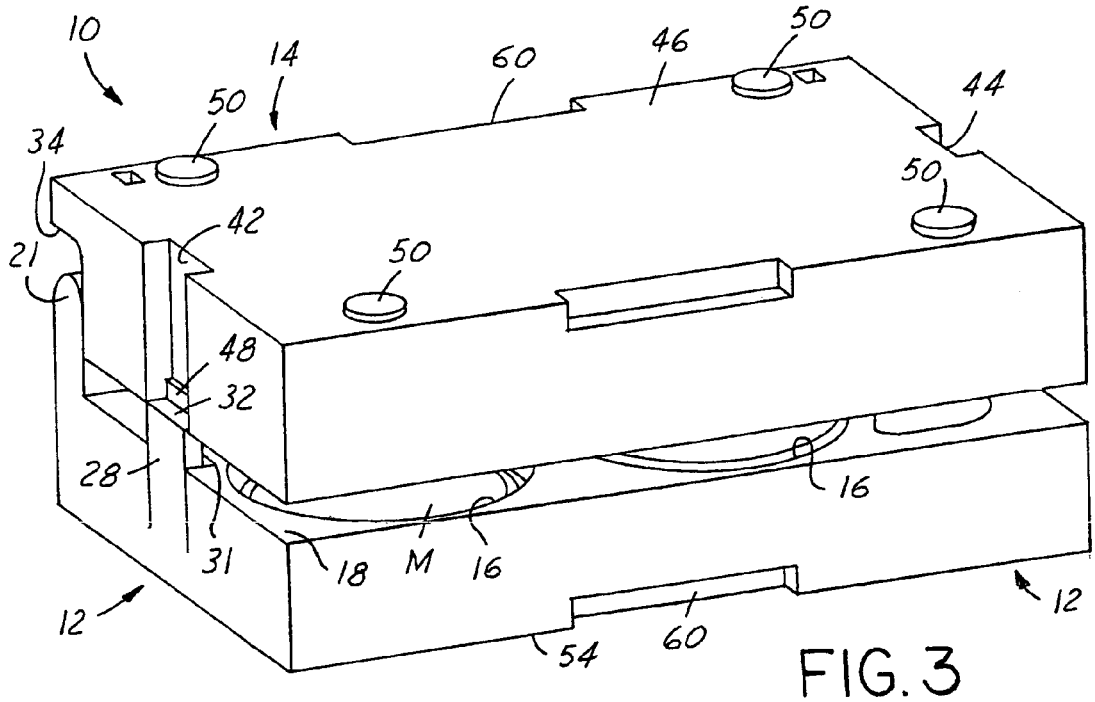
FIG. 3 is a perspective view showing the lid section raised relative to the base section before being pivoted to open position.

To pivot the lid section 14 relative to the base section 12 from the closed position of FIG. 4 to the open position of FIG. 2, the latches 28 and 30 are flexed outwardly by hand to the broken line position of FIG. 6 to disengage the latch prongs 32 from the ledges 48. Then the lid section is raised to the FIG. 3 position while remaining parallel to the base section, so that the lid section clears the meters prior to pivoting the lid section relative to the base section, after which the lid section is pivoted to the open position of FIG. 2. The lid section may be pivoted back to the closed position by reversing the steps for opening the lid section. The lid section may be separated from the base section by flexing the posts 21 and 22 laterally outwardly by hand to the broken line positions of FIG. 5 far enough to disengage the hinge pins 24 and 26 from the slots 38.

Hand hold recesses 60 are provided in the lid and base sections for convenience in carrying the tote.

Referring to FIGS. 7-15, there is shown a tote 60 of modified construction, having a lid section 62 and a base section 64.

The lid section 62 is in the form of a shallow, rectangular, pan-shaped shell 66 having a bottom wall 68, spaced apart side walls 70 and 72, and spaced apart front and rear walls 74 and 76. The walls 70-76 are perpendicular to the bottom wall 68 and form with the bottom wall a rectangular, open-top receptacle for generally flat lid panel inserts 78 and 80.

The lid panel insert 78 is parallel to the bottom wall 68 of the lid section 62 and lays flat against the bottom wall. The panel insert 78 has four, integral, generally circular, support pads 82, 84, 86 and 88 for supporting the meters M. The support pads 82-88 are held together by an integral panel body 89. The panel insert 80 is parallel to the bottom wall 68 of the lid section 62 and lays flat against the panel insert 78. The panel 80 has four generally circular apertures 90, 92, 94 and 96. The apertures 90-96 overly and are aligned with the respective pads 82-88 to provide four lid cavities 98, 100, 102 and 104.

The base section 64 is in the form of a shallow, rectangular, pan-shaped shell 106 having a bottom wall 108, spaced apart side walls 110 and 112, and spaced apart front and rear walls 114 and 116. The walls 110-116 are perpendicular to the bottom wall 108 and form with the bottom wall a rectangular, open-top receptacle for generally flat base panel inserts 118, 120 and 122.

The base panel insert 118 is parallel to the bottom wall 108 of the base section 64 and lays flat against the bottom wall. The panel insert 118 has four generally circular apertures 124, 126, 128 and 130. The panel insert 120 is parallel to the bottom wall 108 of the lid section 64 and lays flat against the panel insert 118. The panel insert 120 has four generally circular apertures 132, 134, 136 and 138. The panel insert 122 is parallel to the bottom wall 108 of the base section 64 and lays flat against the panel insert 120. The panel insert 122 has four generally circular apertures 140, 142, 144 and 146. The apertures 124-130 in the panel insert 118 overly and are aligned with the respective apertures 132-138 in the panel insert 120, and with the respective apertures 140-146 in the panel insert 122 to provide four lid cavities 148, 150, 152 and 154.

The rear wall 76 of the lid section 62 is pivotally connected to the rear wall 116 of the base section 64 by a hinge 156 for pivotal movement of the lid section relative to the base section between a closed position and an open position. When the lid section is closed relative to the base section, the base cavities 148-154 confront the respective lid cavities 98-104 to provide a plurality of meter pockets 160. Each of the meter pockets is adapted to receive and locate one of the meters M.

The apertures 132-138 in the base panel insert 120 and the apertures 140-146 in the base panel insert 122 are all of the same diameter. However, the apertures 124-130 in the base panel insert 118 are of a smaller diameter than the apertures 132-138 and 140-146 such that the base panel insert 118 provides an annular meter support 162 for each of the pockets 160 to support a rim 164 projecting radially outwardly from one end of the body 166 of each of the meters.

The front wall 74 of the lid section 62 has several recesses along its length from one side wall to the other. Near each end, the front wall 74 is displaced inwardly to provide an outwardly facing recess 168 which extends from the bottom wall 68 of the lid section 62 to the free edge thereof. Between the recesses 168 and the side walls 70 and 72, the front wall 74 at each end is displaced outwardly at its free edge to provide an outward notch 170. At the midpoint in the width of the lid section 62, the bottom wall 68 and front wall 74 are recessed adjacent to a hand hole 172 in the bottom wall for convenience in carrying the tote.

The lid panel insert 78 is centered on the inner surface of the bottom wall 68 of the base section 62 and is preferably removably secured thereto as by a suitable adhesive. The panel insert 80 is generally rectangular and fits closely within the side, front and rear walls 70-76 of the base section. The outer edge of the base panel insert 80 conforms generally to the shape of the front wall 74, having outward projections 174 at the side edges which extend into the notches 170. The panel insert 80 is preferably removably secured to the panel insert 78 as by a suitable adhesive.

The front wall 114 of the base section 64 has several recesses along its length from one side wall to the other. Near each end, the front wall 114 is displaced inwardly to provide an outwardly facing recess 176 which extends from the bottom wall 108 of the base section to the free edge thereof. Between the recesses 176 and the sidewalls 110 and 112, the front wall 114 at each end is displaced outwardly at its free edge to provide an outward notch 180. At the midpoint in the width of the base section 64, the bottom wall 108 and front wall 114 are recessed adjacent to a hand hole 182. The hand hole 182 cooperates with the hand hole 172 in the lid section 62 for the hand of a person carrying the closed tote.

The base panel inserts 118, 120 and 122 are generally rectangular and fit closely within the side, front and rear walls 110-116 of the base section 64. The panel inserts 118-122 are preferably removably secured together as by a suitable adhesive. The panel insert 118 is preferably removably secured to the bottom wall 108 also by a suitable adhesive. The outer edge of the panel insert 122 also conforms generally to the shape of the front wall 114 and has outward projections 184 at the side edges which extend into the notches 180, and which may be adhesively secured thereto.

When the lid section 62 is closed relative to the base section 64, the recesses 168 in the front wall 74 of the lid section are aligned with the recesses 176 in the front wall of the base section. The lid section is held closed on the base section by straps 186. The straps extend around the tote, extending through the aligned recesses 168 and 176 in the front walls of the lid and base sections. Buckles 188 releasably secure the ends of the straps together. Rivets 190 secure the straps 186 to the base and lid sections.

The tote shown in FIGS. 7-15 may be used to carry articles such as meters which are larger or smaller than the meters M by merely substituting panel inserts having larger or smaller apertures than the panel inserts described above. The panel inserts, even if adhesively secured to one another and to the base and lid sections, are easily removable for the substitution of other panel inserts.

What is claimed is:

1. A tote for carrying electric meters having a body and an outwardly projecting rim, which includes:

a base section and a lid section, each of said sections comprising a hollow pan-shaped shell having a bottom wall, spaced apart sidewalls projecting upwardly from opposite edges of said bottom wall, and spaced apart front and rear walls projecting upwardly from opposite edges of said bottom wall, a hinge connecting said rear walls of said sections for pivotal movement of said sections between a closed position and an open position, at least two base panel inserts removably disposed in said shell of said base section, said base panel inserts being generally flat, parallel to the bottom wall of said base section and in surface-to-surface relation with one another, at least two lid panel inserts removably disposed in said shell of said lid section, said lid panel inserts being generally flat, parallel to said bottom wall of said lid section and in surface-to-surface relation with one another, a first of said lid panel inserts resting on the bottom wall of said lid section and having a plurality of spaced apart circular pads, a second of said lid panel inserts resting on said first lid panel insert and having a plurality of spaced apart circular apertures aligned with and overlying respective pads to provide respective open lid cavities, a first of said base panel inserts resting on the bottom wall of said base section and having a plurality of spaced apart circular apertures, a second of said base panel inserts resting on said first base panel insert and having a plurality of spaced apart circular apertures aligned with and overlying respective apertures in said first base panel insert to provide respective open base cavities, said apertures in said first base panel insert being of smaller diameter than apertures in said second base panel insert forming an annular shoulder within each of said base cavities, said base cavities and said lid cavities being in opposed alignment with said lid section and said base section in said closed position to capture electric meters between said annular shoulders and said pads with the bodies of the electric meters engaging said pads and the rims of the electric meters engaging said annular shoulders.

2. The tote set forth in claim 1 wherein said pads are recessed into said first lid panel insert.

3. The tote set forth in claim 1 including aligned recesses in said front walls of said base and lid sections, and a latch mechanism disposed in said recesses such that said latch mechanism is disposed within an outer perimeter defined by said front, rear and side walls to hold said base and lid sections closed.

4. The tote set forth in claim 3 including a handle formed in opposed portions of said front walls of said base and lid sections adjacent to said latch mechanism, said handle being disposed within said outer perimeter defined by said front, rear and side walls of said base and lid sections.

5. The tote set forth in claim 1 wherein said front walls of said base and lid shells have corner notches, and at least said second panel inserts have corner projections received within said corner notches to hold said second panel inserts in place.

* * * * *